United States Patent [19]

Cysewski

[11] Patent Number: 4,881,345

[45] Date of Patent: Nov. 21, 1989

[54] VERTICALLY ROTATABLE GATE

[76] Inventor: Jerome Cysewski, P.O. Box 1998, Billings, Mont. 59103

[21] Appl. No.: 241,910

[22] Filed: Sep. 7, 1988

[51] Int. Cl.[4] ..... E05D 7/00

[52] U.S. Cl. ..... 49/385

[58] Field of Search ..... 49/385, 327

[56] References Cited

U.S. PATENT DOCUMENTS

| | | | |
|---|---|---|---|
| 560,124 | 5/1896 | Emrick | 49/385 |
| 612,514 | 10/1898 | Bruner | 49/385 X |
| 622,735 | 4/1899 | Vernon | 49/385 |
| 1,563,266 | 11/1925 | Durham | 49/385 |
| 1,611,367 | 12/1926 | Pickett | 49/385 X |
| 4,535,534 | 6/1891 | Barker | 49/385 X |

*Primary Examiner*—Philip C. Kannan

*Attorney, Agent, or Firm*—Richard C. Conover

[57] ABSTRACT

A vertically rotatable gate which incorporates a torsion beam strengthened by bracing stringers to form a compact, rigid foundation structure along the bottom of the gate for resisting torsional and transverse forces acting on the gate. Further, a separate carriage assembly may be used to mount gates of different sizes to a gate axle.

4 Claims, 1 Drawing Sheet

VERTICALLY ROTATABLE GATE

BACKGROUND OF THE INVENTION

This invention relates to a vertically rotatable gate assembly rotatable about an axle and in particular to the structure of the gate assembly for resisting torsional and transverse forces acting on the gate assembly.

Vertically rotating gates which incorporate triangular bracing to resist transverse forces acting on the gate are known. For example, U.S. Pat. No. 612,514 to Bruner; U.S. Pat. No. 622,735 to Vernon; U.S. Pat. No. 560,124 to Emrick; and U.S. Pat. No. 1,563,266 to Durham illustrate gates which rotate vertically to open and also incorporate triangular bracing components on either side of the gate to add strength.

A problem with these gates, however, is that none show a compact bracing structure located at the bottom portion of the gate to resist both torsional forces and transverse forces acting on the gate.

SUMMARY OF INVENTION

The present invention is directed to a vertically rotatable gate which incorporates a torsion beam strengthened by bracing stringers to form a compact, rigid foundation structure along the bottom of the gate for resisting torsional and transverse forces acting on the gate. Further, a separate carriage assembly may be used to mount gates of different sizes to the gate axle.

The gate, according to the present invention, includes a torsion beam extending the length of the gate assembly along the bottom of the gate. This torsion beam is mounted to the gate axle about which the entire gate assembly is rotatable. Further, a pair of bracing stringers are mounted on either side of the torsion beam in triangular fashion to resist transverse forces acting on the torsion beam.

A plurality of fence stiles each having an end connected to the torsion beam and extending to the top of the gate assembly are provided for supporting a fence mounted to the fence stiles. These fence stiles are mounted in a cantilever fashion and together form a fence plane surface. A fence is mounted to the fence stiles on the plane fence surface and is supported by the fence stiles.

Transverse forces applied to the fence are directed to the torsion beam and are resisted thereby. Any transverse forces acting on the torsion beam are resisted by the bracing stringers.

Thus, a compact structure is provided which is located at the bottom portion of the gate to resist both torsional forces and transverse forces acting on the gate.

BRIEF DESCRIPTION OF THE DRAWINGS

In order that the invention may be clearly understood and readily carried into effect, a preferred embodiment of the invention will now be described, by way of example only, with reference to the accompanying drawings.

DESCRIPTION OF THE PREFERRED EMBODIMENT

Figure 1:
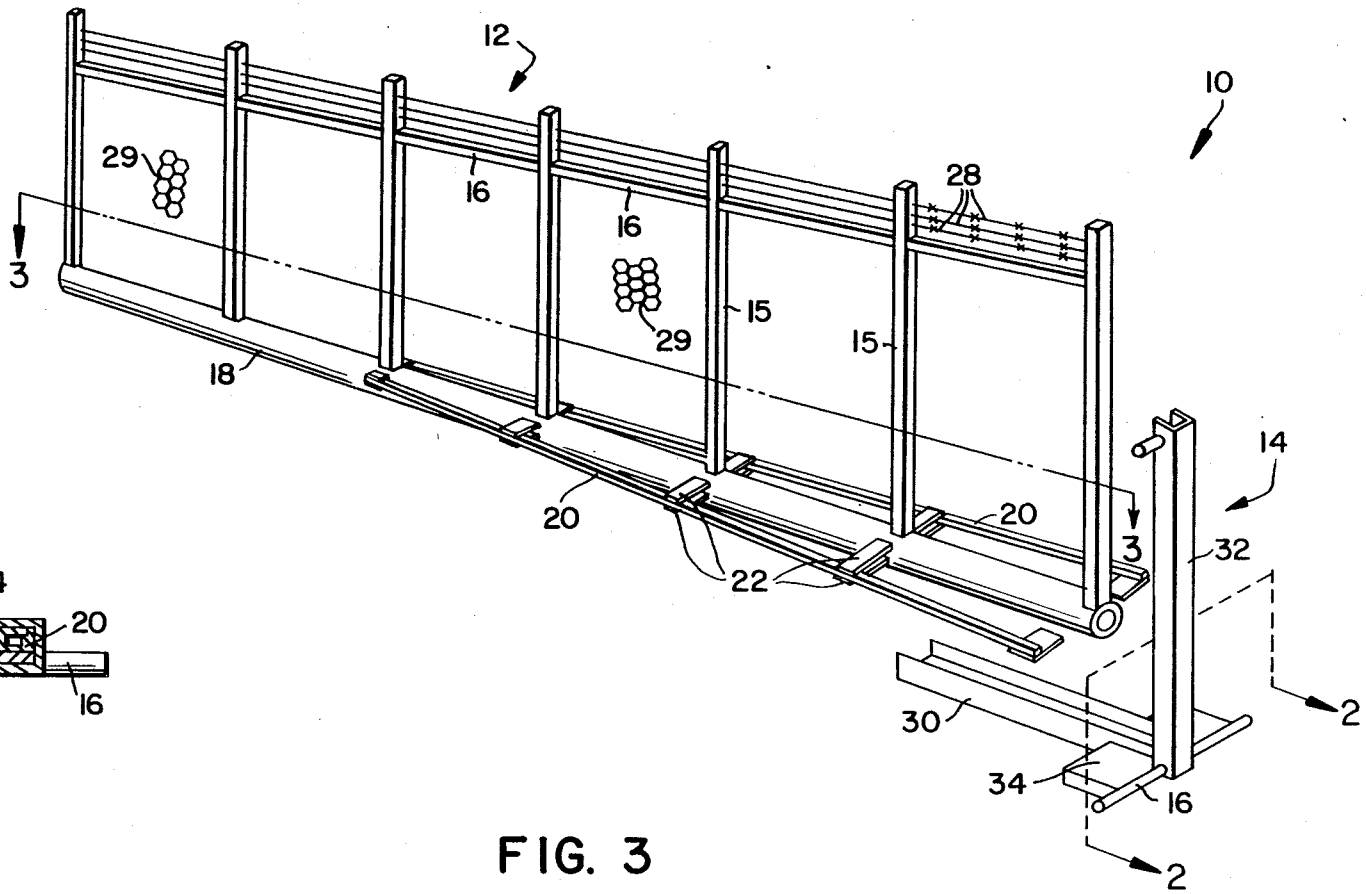
FIG. 1 is an exploded perspective side view illustrating the gate assembly according to the present invention.

A vertically rotatable gate assembly 10 according to the present invention is shown in FIG. 1. Here, the gate assembly 10 is shown in an exploded view wherein a gate fence assembly 12 is separated from a carriage assembly 14 which in turn is mounted to a main gate axle 16 about which the gate fence assembly 12 rotates.

The gate fence assembly 12 includes a torsion beam 18 which extends the length of the gate fence assembly 12 along the bottom thereof as shown in FIG. 1. In a preferred embodiment, a pair of bracing stringers 20 are secured in triangular fashion to torsion beam 18. The bracing stringers 20 are spaced apart from torsion beam 18 near a first end of the torsion beam 18 adjacent the axle 16 in a direction generally parallel to the longitudinal axis of axle 16 and extend in a direction converging on torsion beam 18 on either side of torsion beam 18 to a point where they are secured to the torsion beam 18 as shown in FIG. 1. A plurality of formers 22 rigidly connect bracing stringers 20 to the torsion beam 18. Together the bracing stringers 20, the formers 22 and torsion beam 18 form a compact, rigid foundation extending along the bottom of gate fence assembly 12.

Fence stiles 15, each having an end connected to the torsion beam, extend upwardly to the top of the gate fence assembly 12. Each of the fence stiles has an end connected to the torsion beam and extends upwardly in cantilever fashion. Stile spacers 16 maintain the fence stiles 15 in spaced apart relation. The fence stiles 15 extend above stile spacers 16 to provide a support surface for strands of barbed wire 28. Together, the fence stiles 15 are positioned to form a plane fence surface on which a fence 29 is attached.

As shown in FIG. 1, the carriage assembly 14 accepts the gate fence assembly 12 and is constructed to accept gate fence assembly 12 of different sizes thus adding to the versatility of the present structure. Carriage assembly 14 includes a first arm 30 which, in a preferred embodiment, includes a U-shaped channel extending beneath torsion beam 18. This channel is sized to accept the torsion beam 18 within the channel. Further, the first arm is secured to torsion beam 18. A second arm 32 is mounted to first arm 30 at a right angle and, in a preferred embodiment, is a U-shaped channel sized to accept the fence stile 15 at the end of torsion beam 18 adjacent the axle 16. This fence stile 15 is secured to arm 32.

Figure 2:
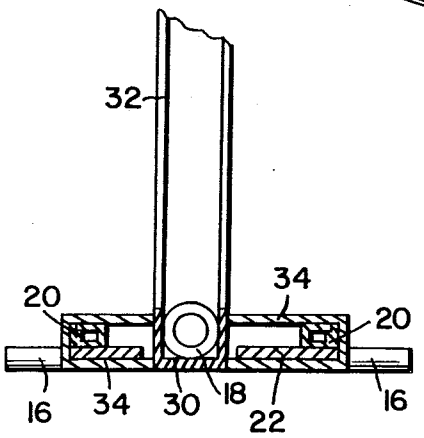
FIG. 2 is a cross-sectional view taken along the line 2—2 in FIG. 1.
Figure 3:
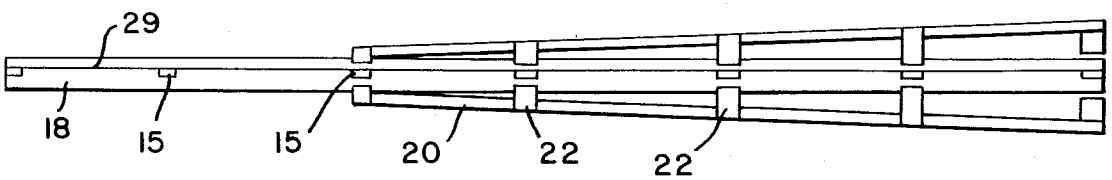
FIG. 3 is a cross-sectional view taken along the line 3—3 in FIG. 1.

At the juncture of first arm 30 and second arm 32, a stringer mounting structure 34 is provided for securing the end of bracing stringers 20 closest to axle 16 to the first arm 30. The stringer mounting structure 34 includes a rectangular box as shown in FIG. 2, which opens at one end. The box being shaped to receive at the open end the stringer 20 and former 22, as shown in FIG. 2. The stringer mounting structure 34 is secured to arm 30 of carriage 14.

With the present invention, any torsional forces tending to twist the gate fence assembly 12 are resisted by the torsion beam 18. Further, as the gate is being raised and transverse forces are applied to the gate fence assembly 12, especially in the situation where the gate assembly is long and subject to bending and twisting, the bracing stringers 20 attached to torsion beam 18 resist this bending movement. It can be seen that the present invention provides a compact, rigid foundation support for the gate fence assembly 12 which enables a gate to be constructed with a fence positioned similar to a conventional gate but with bottom bracing more rigid and compact than has heretofore been known.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A vertically rotatable gate assembly having a top and bottom and rotatable about an axle comprising:

a torsion beam having a first end and a second end, the torsion beam extending the length of the gate assembly along the bottom thereof;

means for mounting the first end of the torsion beam to the axle;

a bracing stringer having a first end and a second end;

the first end of the bracing stringer being mounted to the torsion beam adjacent the first end of the torsion beam and spaced apart therefrom in a direction parallel to the longitudinal axis of the axle and the second end of the bracing stringer converging toward the second end of the torsion beam and secured to the torsion beam;

a plurality of fence stiles, each having an end connected to the torsion beam and extending to the top of the gate assembly, the fence stiles together being positioned to form a plane fence surface;

a fence mounted to the fence stiles on the plane fence surface and being supported by the fence stiles;

whereby torsional forces on the fence are resisted by the torsion beam and forces transverse to the torsion beam are resisted by the bracing stringer.

2. The gate assembly of claim 1 wherein the means for mounting the first end of the torsion beam to the axle includes a carriage assembly mounted to the axle and having a first arm mounted to the torsion beam and extending partially along the bottom thereof and a second arm joined perpendicular to the first arm, the second arm being mounted to the fence stile positioned closest to the axle of the gate.

3. The gate assembly of claim 2 further including stringer mounting means mounted to the first arm for securing a bracing stringer to the first arm of the carriage assembly.

4. The gate assembly of claim 1 further including a plurality of formers rigidly connecting the torsion beam to the bracing stringer at spaced apart locations along the bracing stringer.

* * * * *